US006585127B2

(12) United States Patent
Yang

(10) Patent No.: US 6,585,127 B2
(45) Date of Patent: Jul. 1, 2003

(54) CHAMPAGNE GLASS SET

(76) Inventor: Heng-Te Yang, P.O. Box 90, Tainan City (TW)

( * ) Notice: Subject to any disclaimer, the term of this patent is extended or adjusted under 35 U.S.C. 154(b) by 76 days.

(21) Appl. No.: 09/988,953

(22) Filed: Nov. 21, 2001

(65) Prior Publication Data

US 2003/0094453 A1 May 22, 2003

(51) Int. Cl.[7] ..... B65D 21/02

(52) U.S. Cl. ..... 220/23.86; 220/23.88; 220/592.16; 220/592.17

(58) Field of Search ..... 220/575, 574, 220/592.16, 592.17, 592.18, 23.87, 23.88, 23.86, 697, 735, 736

(56) References Cited

U.S. PATENT DOCUMENTS

| | | | | | |
|---|---|---|---|---|---|
| 277,598 | A | * | 5/1883 | Murray | 220/592.18 |
| 1,021,670 | A | * | 3/1912 | Garey | 220/592.16 |
| 1,858,728 | A | * | 5/1932 | Creighton | 220/574.2 |
| 1,967,699 | A | * | 7/1934 | Young | 211/74 |
| 2,533,355 | A | * | 12/1950 | Comfort | 211/65 |
| 2,624,451 | A | * | 1/1953 | Ewing | 206/541 |
| 5,277,328 | A | * | 1/1994 | Tocco | 220/507 |
| 5,791,534 | A | * | 8/1998 | Davis et al. | 224/148.7 |
| 6,421,890 | B1 | * | 7/2002 | Biggar | 27/1 |
| 6,460,722 | B2 | * | 10/2002 | Lee | 220/592.16 |
| 6,516,967 | B2 | * | 2/2003 | Duff et al. | 220/592.16 |

* cited by examiner

*Primary Examiner*—Joseph M. Moy

(57) ABSTRACT

A champagne glass set in the present invention has a container, a positioning plate and a plurality of glass pieces as main components. The positioning plate has a ring groove disposed at its bottom and a pan-like supporting surface provided with a plurality of holes and inserting recesses disposed therein. The glass pieces can be inserted in centralization into the holes of the supporting surface and placed on the container after being poured with champagne. Moreover, if the positioning plate is taken out of the container and directly placed on a top surface of a table, bottoms of holding stems of the glass pieces can be inserted into the inserting recesses of the supporting surface of the positioning plate and stood erect in the positioning plate with steadiness. Therefore, the champagne glass set is convenient in use, steady in placement without falling, occupied little space, and easy to be stored.

3 Claims, 4 Drawing Sheets

CHAMPAGNE GLASS SET

BACKGROUND OF THE INVENTION

1. Field of the Invention

This invention relates to a champagne glass set, particularly to one permitting a plurality of glass pieces to be inserted in centralization into a plurality of holes or inserting recesses of a supporting surface of a positioning plate with steadiness, which is very convenient in use and occupied with little space. Moreover, the glass pieces all located in one supporting surface can obtain larger area on a top surface of a table to prevent their falling after being bumped.

2. Description of the Prior Art

Generally speaking, bottles of champagne in banquets mostly are kept cool in containers filled with ice cubes therein to make champagne more delicious in drinking. There are many champagne glasses placed on a table and filled with champagne for guests. However, the champagne glasses and the containers carried with champagne bottles and ice cubes occupy too much space on the table so that the champagne glasses are very likely to be tipped over or fallen down to the ground to be broken after being bumped with carelessness. It is also required to have larger space to store the containers and the champagne glasses. Moreover, the way of having the containers and the champagne glasses stored in separate places often requires users to take a lot of time to recall and find out the places where the containers and the champagne glasses are stored after a period of time.

SUMMARY OF THE INVENTION

The main purpose of the invention is to offer a champagne glass set that is very convenient in use, steady in placement without falling and occupied with little space for placement and storage.

The main feature of the invention is to provide a champagne glass set having a container, a positioning plate and a plurality of glass pieces as main components, wherein the container has a circumferential edge formed at its top surface and two handles respectively disposed in its two opposite outer walls; the positioning plate capable of being covered on the container has a ring groove disposed at its bottom for being covered and located on the circumferential edge of the top surface of the container and a pan-like supporting surface provided with a through hole in a center of the supporting surface as well as a plurality of holes disposed therein; the plurality of glass pieces are capable of being inserted in the supporting surface of the positioning plate and each of the glass pieces has a holding stem disposed at its lower portion.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
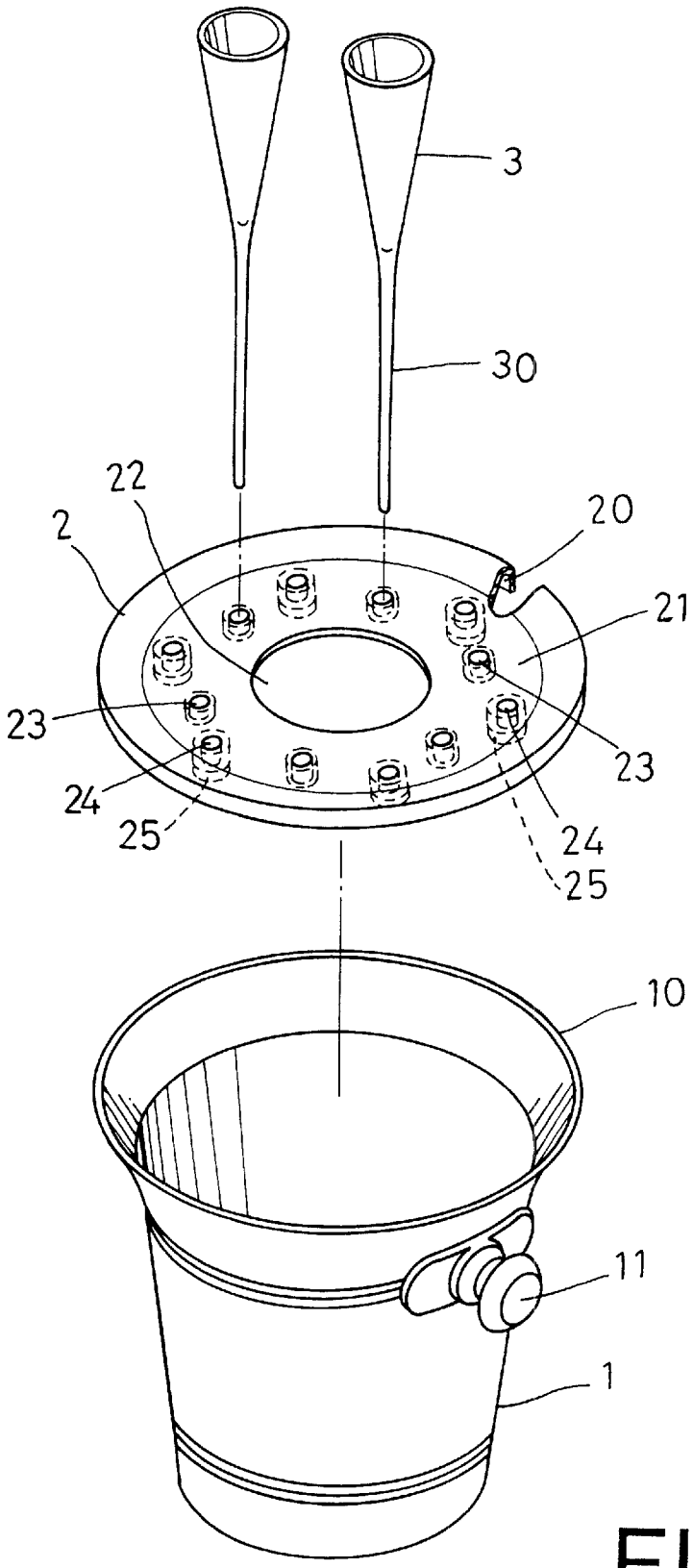
FIG. 1 is an exploded perspective view of a champagne glass set in the present invention.

A first preferred embodiment of a champagne glass set in the present invention, as shown in FIG. 1, includes a container 1, a positioning plate 2 and a plurality of glass pieces 3 as main components. The container 1 has a circumferential edge formed at its top surface in a outward-expanded shape and two handles 11 respectively disposed in its two opposite outer walls. The positioning plate 2 capable of being covered on the container 1 has a ring groove 20 disposed at a bottom of the positioning plate 2 and a pan-like supporting surface 21 provided with a through hole 22 in a center of the supporting surface 21 as well as a plurality of holes 23 and inserting recesses 24 interseptally disposed therein. Each of the inserting recesses 24 has a non-slipping pad 25 disposed at its bottom. The plurality of glass pieces 3 are capable of being inserted in the holes 23 or the inserting recesses 24 of the supporting surface 21 of the positioning plate 2 and each of glass pieces 3 has a holding stem 30 disposed at its lower portion.

Figure 2:
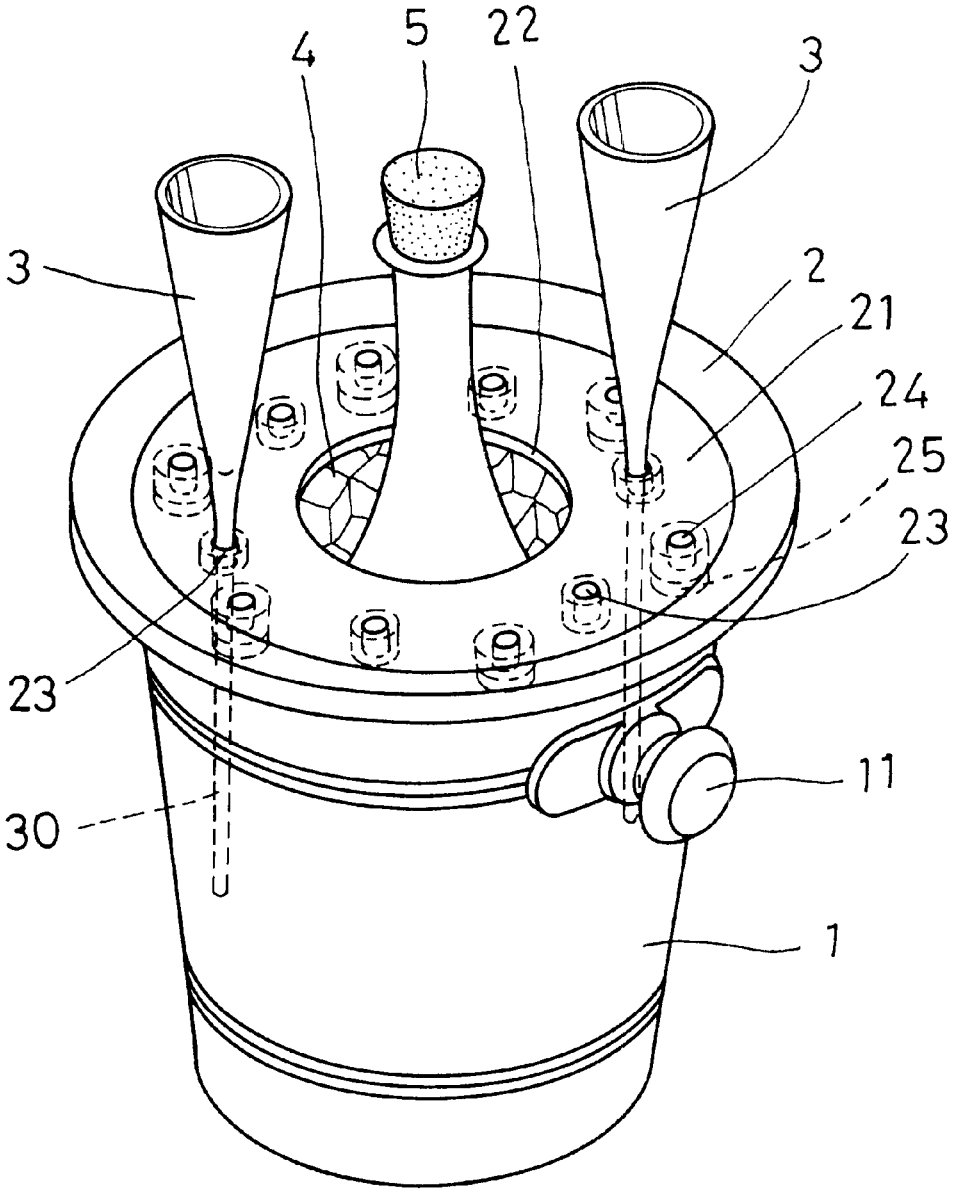
FIG. 2 is a perspective view of the champagne glass set in the present invention.
Figure 3:
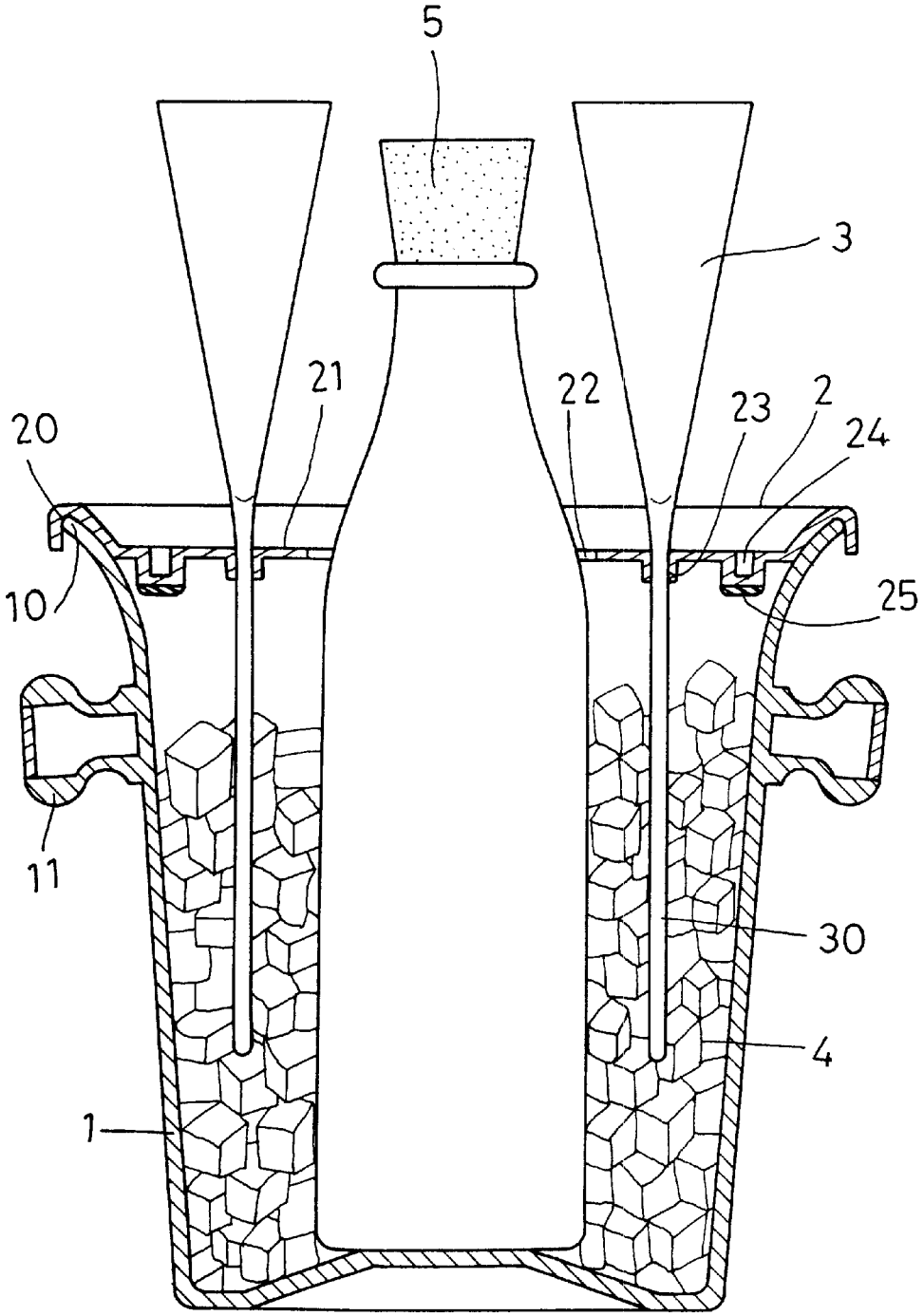
FIG. 3 is a side cross-sectional view of the champagne glass set in the present invention; and, FIG. 4 is a schematic view showing the usage of the champagne glass set in the present invention.

In assembling, referring to FIGS. 2 and 3, firstly cover the positioning plate 2 on the container 1 by having the ring groove 20 at the bottom of the positioning plate 2 to be engaged with the circumferential edge 10 of the top surface of the container 1 so as to have the positioning plate 2 located on the top surface of the container 1. Secondly, insert the holding stems 30 of the glass pieces 3 respectively into the holes 23 of the supporting surface 21 of the positioning plate 2 and have the holding stems 30 of the glass pieces 3 extended downward into the container 1, by which the assemblage of the whole structure is completed and the glass pieces 3 as well as the container 1 can be placed together for storage with little space.

Figure 4:
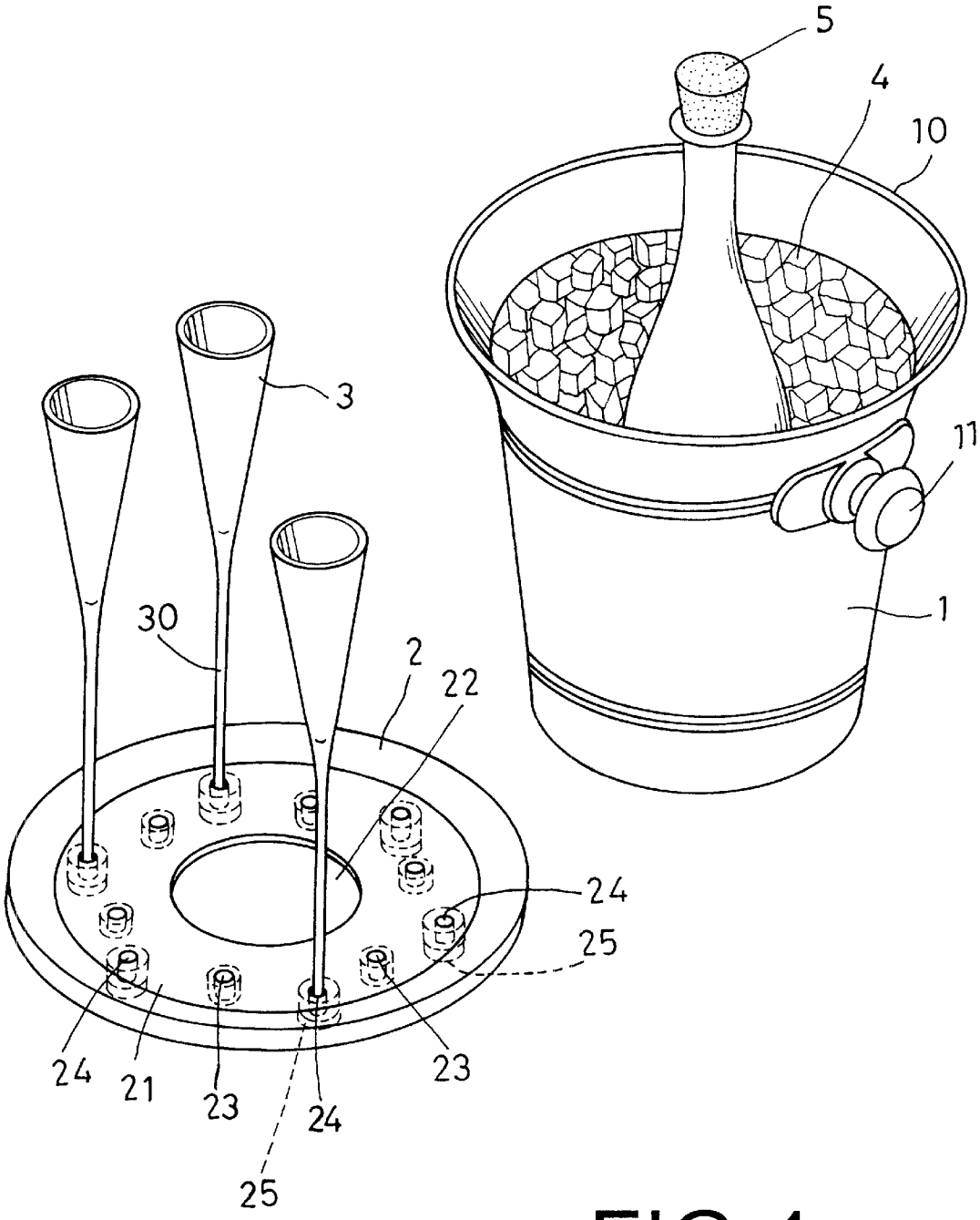

In using, referring to FIGS. 2, 3 and 4, firstly place ice cubes 4 and a champagne bottle 5 into the container 1. Secondly, cover the positioning plate 2 on the container 1 by having the ring groove 20 at the bottom of the positioning plate 2 to be engaged with the circumferential edge 10 of the top surface of the container 1 so as to have the positioning plate 2 located on the top surface of the container 1 and allowing an upper portion of the champagne bottle 5 to be extended upward out of the through hole 22 of the supporting surface 21 of the positioning plate 2. Thirdly, insert the holding stems 30 of the glass pieces 3 respectively into the holes 23 of the supporting surface 21 of the positioning plate 2 so as to have the holding stems 30 of the glass pieces 3 extended downward into the container 1. And then, hold the handles 11 of the container 1 with two hands and move the glass pieces 3 and the container 1 together to a dinner table. After pouring champagne into the glass pieces 3, insert them into the positioning plate 2 to be ready for drinking, by which the ice cubes 4 in the container 1 can provide champagne with cool temperature to keep its original delicious flavor in a longer period, avoiding its flavor becoming insipid under the higher temperature in the circumference.

Moreover, the positioning plate 2 is capable of being taken out of the container 1 and directly placed on the top surface of the table, as shown in FIG. 4. The non-slipping pads 25 disposed at the bottoms of the inserting recesses 24 of the positioning plate 2 can keep the positioning plate 2 stably stood on the top surface of the table without slipping. At the moment, the bottoms of the holding stems 30 of the glass pieces 3 are capable of being inserted into the inserting recesses 24 of the supporting surface 21 of the positioning plate 2 and stood erect in the positioning plate 2 with steadiness, which is very convenient in use and occupied little space for placement. Moreover, the glass pieces 3 all located in one supporting surface can obtain a larger area on the top surface of the table and are stood more steadily by having the positioning plate 2 acted as their common base to prevent their falling after being bumped.

While the preferred embodiment of the invention has been described above, it will be recognized and understood that various modifications may be made therein and the appended claims are intended to cover all such modifications that may fall within the spirit and scope of the invention.

What is claimed is:

1. A champagne glass set comprising:

a container, a positioning plate and a plurality of glass pieces as main components, wherein said container has a circumferential edge formed at its top surface and two handles respectively disposed in its two opposite outer walls; said positioning plate capable of being covered on said container has a ring groove disposed at a bottom of positioning plate for being covered and located on said circumferential edge of said top surface of said container and a pan-like supporting surface provided with a through hole in a center of said supporting surface as well as a plurality of holes disposed therein; said plurality of glass pieces are capable of being inserted into said supporting surface of said positioning plate and each said glass piece has a holding stem disposed at its lower portion; and, whereby after said positioning plate is covered on a top of said container, said plurality of glass pieces are capable of being inserted in centralization into said holes of said supporting surface of said positioning plate with steadiness to prevent their falling after being bumped and poured with champagne, which is very convenient in use and occupied little space.

2. The champagne glass set as claimed in claim 1, wherein a plurality of inserting recesses are disposed in said supporting surface of said positioning plate so that after said positioning plate is taken out of said container and directly placed on said top surface of said table, bottoms of said holding stems of said glass pieces are capable of being inserted into said inserting recesses of said supporting surface of said positioning plate and stood erect in said positioning plate with steadiness, which is very convenient in use and occupied little space; said glass pieces can obtain a larger area on said top surface of said table and are stood more steadily by having said positioning plate 2 acted as their common base to prevent their falling after being bumped.

3. The champagne glass set as claimed in claim 2, wherein non-slipping pads are respectively disposed at bottoms of said inserting recesses of said supporting surface of said positioning plate to prevent said positioning plate from slipping.

* * * * *